US009344811B2

(12) United States Patent
Bakish

(10) Patent No.: US 9,344,811 B2
(45) Date of Patent: May 17, 2016

(54) SYSTEM AND METHOD FOR DETECTION OF SPEECH RELATED ACOUSTIC SIGNALS BY USING A LASER MICROPHONE

(71) Applicant: VocalZoom Systems Ltd., Modiin (IL)

(72) Inventor: Tal Bakish, Modiin (IL)

(73) Assignee: VOCALZOOM SYSTEMS LTD., Yokneam Illit (IL)

( * ) Notice: Subject to any disclaimer, the term of this patent is extended or adjusted under 35 U.S.C. 154(b) by 0 days.

(21) Appl. No.: 13/664,470

(22) Filed: Oct. 31, 2012

(65) Prior Publication Data

US 2014/0119737 A1 May 1, 2014

(51) Int. Cl.
*H04R 23/00* (2006.01)

(52) U.S. Cl.
CPC ..... *H04R 23/008* (2013.01)

(58) Field of Classification Search
CPC ..... H04R 23/008
USPC ..... 398/132–134
See application file for complete search history.

(56) References Cited

U.S. PATENT DOCUMENTS

| | | | | | |
|---|---|---|---|---|---|
| 1,527,649 | A * | 2/1925 | Hoxie | 398/133 |
| 1,642,011 | A * | 9/1927 | Chubb | 398/132 |
| 3,286,032 | A * | 11/1966 | Baum | 381/172 |
| 4,143,263 | A * | 3/1979 | Eichweber | 398/170 |
| 4,479,265 | A * | 10/1984 | Muscatell | 398/134 |
| 4,482,805 | A * | 11/1984 | Palmer | 250/227.21 |
| 5,262,884 | A * | 11/1993 | Buchholz | 398/134 |
| 6,014,239 | A * | 1/2000 | Veligdan | 398/134 |
| 6,147,787 | A * | 11/2000 | Veligdan | 398/133 |
| 6,317,237 | B1 * | 11/2001 | Nakao et al. | 398/130 |
| 6,427,014 | B1 * | 7/2002 | Eastty | 381/111 |
| 6,590,661 | B1 * | 7/2003 | Shnier | 356/432 |
| 8,643,846 | B2 * | 2/2014 | Santhanakrishnan et al. | 356/502 |
| 2003/0183294 | A1 * | 10/2003 | Carlson | 138/129 |
| 2004/0076435 | A1 * | 4/2004 | Stolyarov | B60R 16/0315 398/75 |
| 2012/0230699 | A1 * | 9/2012 | Burnett | 398/133 |

OTHER PUBLICATIONS https://en.wikipedia.org/wiki/Laser_microphone The definition of laser microphone.*

* cited by examiner

*Primary Examiner* — Leslie Pascal
(74) *Attorney, Agent, or Firm* — Eitan, Mehulal & Sadot

(57) ABSTRACT

A system for detection of speech related acoustic signals by using laser based detection that includes a mask configured for being worn over a face part of a speaker covering the speaker's mouth, where the mask includes at least one reflective coating covering at least one area of the mask that reflects collimated electromagnetic signals; and a laser microphone configured for detecting vibrations of the reflective coating area for detection of acoustic signals associated with speech of the speaker by using collimated electromagnetic signals. The mask the reflective coating area thereof allow enhancing detection of vibrations resulting from speech carried out by the speaker wearing said mask.

10 Claims, 3 Drawing Sheets

SYSTEM AND METHOD FOR DETECTION OF SPEECH RELATED ACOUSTIC SIGNALS BY USING A LASER MICROPHONE

FIELD OF THE INVENTION

The present invention generally relates to devices, apparatuses, systems and methods for detecting acoustic signals and more particularly to devices for optical detection of acoustic sounds.

BACKGROUND OF THE INVENTION

Optical microphones allow optically detecting human speech related acoustic signals and often rely on facial vibrations for speech detection since optical signals have high sensitivity to vibrating surfaces. However, the output of the optical microphones is of much lower signal quality than that of commonly used acoustic microphones based on transducers that produce electric current upon being vibrated in response to speech related air vibrations.

U.S. Pat. No. 7,775,113 and U.S. application Ser. No. 11/841,134, which are incorporated herein by reference in their entirety, disclose an optical microphone system that includes an optical transmitter and receiver for receiving and transmitting optical signals (beams) for optical detection of speech related acoustic signals by detection of, inter alia, facial vibrations of a relevant speaker. These optical microphones can use techniques such as vibrometry, self-mix and/or interferometry, for instance, for acoustic signals detection.

SUMMARY OF THE INVENTION

According to some embodiments of the present invention there is provided a system for detection of speech related acoustic signals by using laser based detection that includes a mask configured for being worn over a face part of a speaker covering the speaker's mouth, where the mask includes at least one reflective coating covering at least one area of the mask that reflects collimated electromagnetic signals; and a laser microphone configured for detecting vibrations of the reflective coating area for detection of acoustic signals associated with speech of the speaker by using collimated electromagnetic signals. The mask the reflective coating area thereof allow enhancing detection of vibrations resulting from speech carried out by the speaker wearing said mask.

Optionally, the reflective coating comprises at least one patch having a reflective surface, each patch is attached to the mask. Alternatively, the reflective coating comprises a coating layer covering at least one area of the mask. In other embodiments at least part of the mask is made from a reflective material.

According to some embodiments of the invention, the laser microphone uses vibrometry, self-mix and/or interferometry techniques to detect acoustic vibrations.

Optionally, the laser microphone comprises a laser based optical transmitter configured for transmitting a coherent laser beam towards the speaker's mouth area, which is covered by the mask, a corresponding optical sensor for detecting the reflected optical signals from the reflective coating thereof and a processor for processing the sensed signals for detecting the acoustic signals.

According to some embodiments, the laser microphone is connected to at least one processor for processing the sensed signals for detecting the acoustic signals from the laser microphone output, where the processor may be configured for operating at least one noise reduction algorithm.

According to some embodiments of the invention, the system further comprises one or more audio output devices such as speakers for outputting the acoustic output signal of the laser microphone.

DETAILED DESCRIPTION OF SOME EMBODIMENTS OF THE INVENTION

In the following detailed description of various embodiments, reference is made to the accompanying drawings that form a part thereof, and in which are shown by way of illustration specific embodiments in which the invention may be practiced. It is understood that other embodiments may be utilized and structural changes may be made without departing from the scope of the present invention.

The present invention, in some embodiments thereof, provides a system for laser based detection of speech related acoustic signals, where the acoustic signals are associated with speech of a speaker. According to some embodiments the system includes a mask configured for being worn over a face part of the speaker covering the speaker's mouth having one or more reflective surfaces thereover; and an optical microphone configured for optically detecting vibrations of the reflective surface or surfaces for detection of acoustic signals associated with speech of the speaker.

The one or more reflective surfaces may be attached to the mask (e.g. using reflective patches that are attached to areas over a regular face mask through adhesives) or coating the mask by having a reflective layer coating at least one area of the mask around configured to cover the mouth area of the speaker wearing thereof.

The optical microphone may include a laser optical transmitter for transmitting a coherent laser beam towards the speaker's mouth area, which is covered by the special mask, and a corresponding optical receiver/sensor(s) for detecting the reflected optical signal thereof. Various aspects of the differences between the transmitted optical signal and the reflected received optical signal are used to detect and extract the speech related acoustic signal features. The optical microphone can be based on techniques for vibration detection such as vibrometry, self-mix and/or interferometry, for instance.

The mask may be designed as a surgeon mask, which is often made of lightweight materials and has straps for allowing a user to hold it worn over his/her face by tying the straps over his/her ears. The one or more reflective surfaces may be added to the mask by attaching (e.g. by adhering) one or more light-reflective patches over a standard surgeon mask, coating the mask with a coating layer adhered thereto, manufacturing the mask from a reflective material (e.g. a fabric having a reflective weave embedded thereto), or by using any other technique for creating reflective area(s) over a mask.

Figure 1:
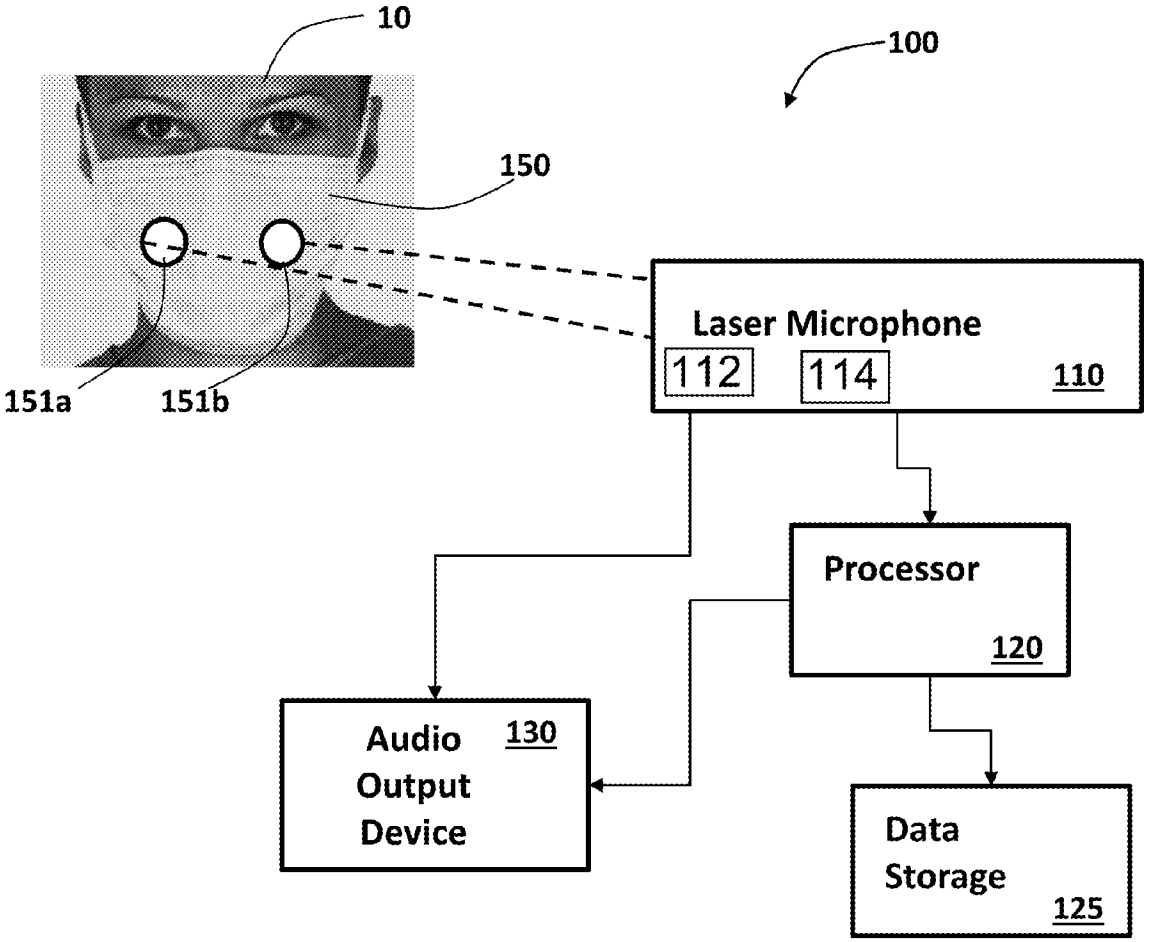
FIG. 1 schematically illustrates a system for optical detection of speech related acoustic signals including a facial mask with multiple attached reflective patches, according to some embodiments of the present invention.

Reference is now made to FIG. 1, schematically illustrating a system 100 for optical detection of speech related acoustic signals, according to some embodiments of the invention. The system 100 includes: (i) an optical microphone 110; (ii) a mask 150 configured for being worn over a face part of a speaker 10 covering the speaker's mouth area; and (iii) one or more audio output devices such as a speaker 130.

According to some embodiments, as illustrated in FIG. 1, the system 100 also includes a computer processor 120 for receiving data/signals from the optical microphone 110 and analyzing/processing thereof capable of outputting data associated with the speech acoustic signal and data storage 125 for storing the processed data and/or the raw output of the optical microphone.

According to these embodiments, as shown in FIG. 1, the mask ISO includes a multiplicity of reflective surfaces 151*a* and 151*b* attached thereover in the mouth area of the speaker 10. The reflective patches 151*a* and 151*b* may be, for example, adhered to a standard surgeon mask or printed thereover using fabric printing techniques.

According to some embodiments, the optical microphone 110 includes an infrared (IR) transmitter 112 and receiver 116 for transmitting IR signals and receiving their optical signals reflected back from the reflective as well as non-reflective surfaces of the mask ISO when the speaker 10 speaks for outputting a signal or data that represents the speech related acoustic signal outputted by the speaker 10.

Since the mask blocks some of the air exhaled by the speaker during speech, it enhances the vibrating related to speech and therefore enhances the ability to optically detect speech related vibrations. Adding reflective surfaces thereto further enhances the ability and quality of detection of the speech related vibration in the mouth area of the speaker.

For example, the optical microphone 110 includes means for carrying out interferometry between the transmitted and reflected optical (e.g. IR) signal such as an interferometer outputting an optical signal and/or data representing thereof indicative of the difference between the transmitted and reflected signals (such as phase shift therebetween). In other cases the optical microphone 110 uses self-mixing of the transmitted and reflected signals for outputting data/signal that is indicative of the speech related acoustic data/signal.

In other embodiments, coherent electromagnetic laser beams/waves in the non-visual frequency ranges may be used instead of optical signals, using reflective surfaces (e.g. painted, covered or coated) that can reflect collimated electromagnetic signals in these non-visual frequency ranges.

Figure 2:
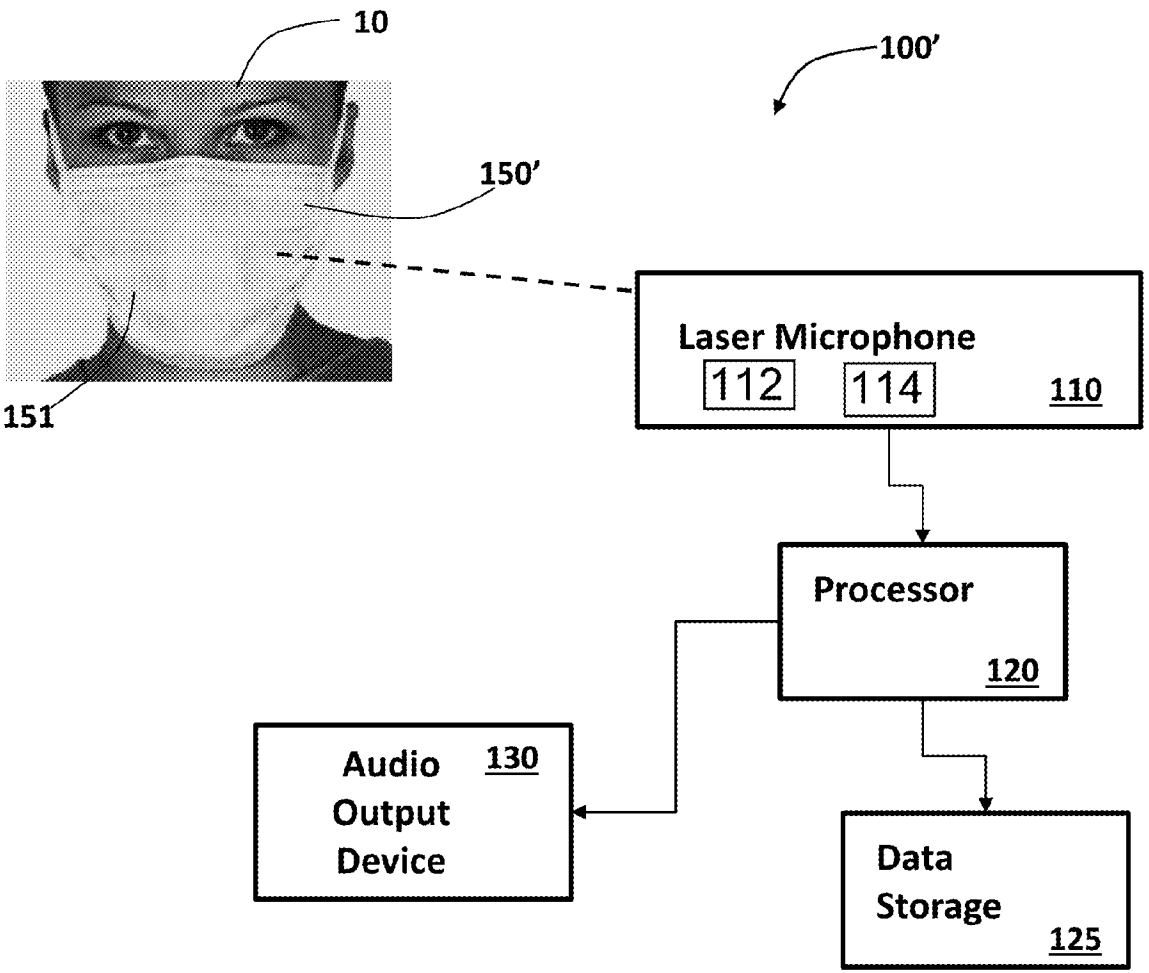
FIG. 2 schematically illustrates a system for optical detection of speech related acoustic signals including a facial mask coated by a reflective layer, according to other embodiments of the present invention.

Reference is now made to FIG. 2, schematically illustrating another similar system 100' for optical detection of speech related acoustic signals, according to some embodiments of the invention. The system 100' includes: (i) the same optical laser microphone 110, including the transmitter 112 and receiver 114; (ii) another type of mask 150' configured for being worn over a face part of a speaker 10 covering the speaker's mouth area; (iii) the audio output device 130; (iv) the computer processor; (v) and the data storage 125. This mask 150' has a coating layer 151 thereover that is reflective in the signal range corresponding to the range of the laser microphone 110.

Figure 3:
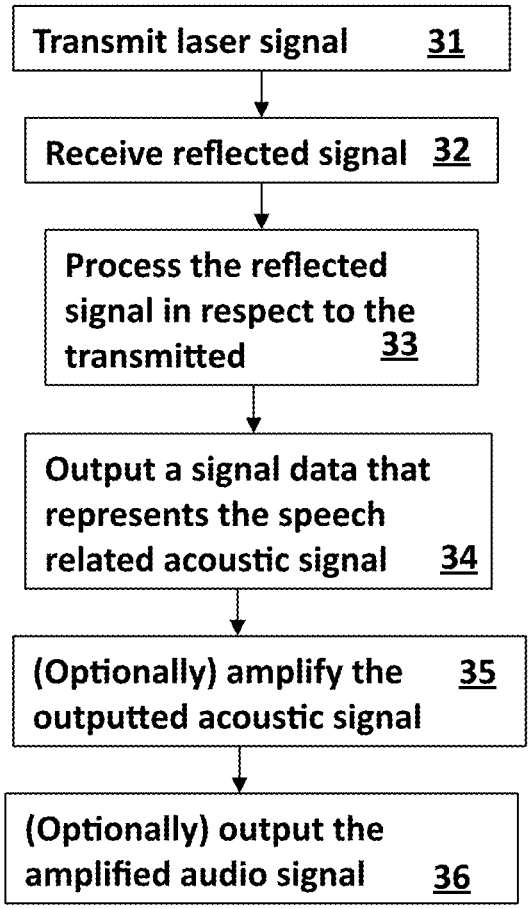
FIG. 3 is a flowchart, schematically illustrating a process/method for detection of speech related acoustic signals by using laser based detection, according to some embodiments of the invention

Reference is now made to FIG. 3, which is a flowchart; schematically illustrating a process/method for detection of speech related acoustic signals by using laser based detection, according to some embodiments of the invention. the method includes: (i) transmitting a collimated electromagnetic signal (e.g. optical IR signal) using a laser based microphone 31; (ii) receiving a reflected signal associated with the transmitted one, using the laser microphone, where the reflected signal is a signal that was reflected from a reflecting surface of a mask worn by the speaker 32; (iii) processing the reflected signal in respect to its corresponding transmitted signal 33 e.g. either by using optical means such as interferometry or self-mixing means and/or by analyzing the characteristics of the received reflected signal in respect to known characteristics of the transmitted signal (such as wavelength/frequency, intensity, phase and the like); and (iv) outputting the speech related extracted acoustic signal 34 either as data and/or as an acoustic signal.

The method may optionally include amplifying the extracted acoustic signal 35 and then outputting it by using audio output means such as a speaker and the like 36.

According to some embodiments of the invention, any one or more noise reduction, amplification and filtering techniques and algorithms may be used to output a high quality acoustic signal of the relevant speaker wearing the mask such as voice activity detection (VAD) techniques, comb filtering and the like.

Many alterations and modifications may be made by those having ordinary skill in the art without departing from the spirit and scope of the invention. Therefore, it must be understood that the illustrated embodiment has been set forth only for the purposes of example and that it should not be taken as limiting the invention as defined by the following invention and its various embodiments and/or by the following claims. For example, notwithstanding the fact that the elements of a claim are set forth below in a certain combination, it must be expressly understood that the invention includes other combinations of fewer, more or different elements, which are disclosed in above even when not initially claimed in such combinations. A teaching that two elements are combined in a claimed combination is further to be understood as also allowing for a claimed combination in which the two elements are not combined with each other, but may be used alone or combined in other combinations. The excision of any disclosed element of the invention is explicitly contemplated as within the scope of the invention.

The words used in this specification to describe the invention and its various embodiments are to be understood not only in the sense of their commonly defined meanings, but to include by special definition in this specification structure, material or acts beyond the scope of the commonly defined meanings. Thus if an element can be understood in the context of this specification as including more than one meaning, then its use in a claim must be understood as being generic to all possible meanings supported by the specification and by the word itself.

The definitions of the words or elements of the following claims are, therefore, defined in this specification to include not only the combination of elements which are literally set forth, but all equivalent structure, material or acts for performing substantially the same function in substantially the same way to obtain substantially the same result. In this sense it is therefore contemplated that an equivalent substitution of two or more elements may be made for any one of the elements in the claims below or that a single element may be substituted for two or more elements in a claim. Although elements may be described above as acting in certain combinations and even initially claimed as such, it is to be expressly understood that one or more elements from a claimed combination can in some cases be excised from the combination and that the claimed combination may be directed to a sub-combination or variation of a sub-combination.

Insubstantial changes from the claimed subject matter as viewed by a person with ordinary skill in the art, now known or later devised, are expressly contemplated as being equivalently within the scope of the claims. Therefore, obvious substitutions now or later known to one with ordinary skill in the art are defined to be within the scope of the defined elements.

The claims are thus to be understood to include what is specifically illustrated and described above, what is conceptually equivalent, what can be obviously substituted and also what essentially incorporates the essential idea of the invention.

Although the invention has been described in detail, nevertheless changes and modifications, which do not depart from the teachings of the present invention, will be evident to those skilled in the art. Such changes and modifications are deemed to come within the purview of the present invention and the appended claims.

Sound sources separation and monitoring using directional coherent electromagnetic waves.

An apparatus and a method that achieve physical separation of sound sources by pointing directly a beam of coherent electromagnetic waves (i.e. laser). Analyzing the physical properties of a beam reflected from the vibrations generating sound source enable the reconstruction of the sound signal generated by the sound source, eliminating the noise component added to the original sound signal. In addition, the use of multiple electromagnetic waves beams or a beam that rapidly skips from one sound source to another allows the physical separation of these sound sources. Aiming each beam to a different sound source ensures the independence of the sound signals sources and therefore provides full sources separation.

The present invention relates to coherent electromagnetic waves and more specifically, to remote sensing of sound sources using coherent electromagnetic waves.

Vibrometry is the technical field of measuring vibrations of an object. In remote vibrometry, the vibrations are measured from a distance (aka no-contact vibrometry). One of the common ways to achieve vibrations remote-sensing is by using coherent electromagnetic waves (usually laser) and exploiting their physical properties.

Specifically, the vibrating object acts as a transducer by modifying the properties of the electromagnetic waves that hit it, according to the vibrations, prior to reflecting back the electromagnetic waves. As any sound source generates vibrations, coherent electromagnetic waves may be used to detect and sense sound. And indeed, many attempts have been made in the art of remote sound sensing and detection using coherent electromagnetic waves.

The majority of the coherent electromagnetic-waves-based sound vibrometers available today are configured so that the coherent electromagnetic waves are not directed at the vibrating sound source. Rather, the electromagnetic waves in these sound vibrometers are directed at objects that reflect the sound waves, usually flat surfaces such as windows and walls in the proximity of the sound generating object.

For example, U.S. Pat. No. 6,317,237 discloses a system wherein a laser beam is directed at a window pane of a building and the reflecting laser beam is received and analyzed to extract the sound waves (specifically human voices) generated within the building.

U.S. Pat. No. 5,175,713 discloses a method for under-water sound sensing using laser beams directed at reflectors and analyzing the reflected beams in order to detect and sense under-water sound propagation.

Presently available remote sensing sound vibrometers use a variety of techniques to extract the information from the reflected beam. The traditional solution comprises an interferometer that conducts interference between the reflected beam and a reference beam. Another common technique is based upon the Doppler Effect. According to this technique, since the wavelength of the reflected beam is changed in accordance with the vibrations of the vibrating object that reflects the electromagnetic waves therefore the change in wavelength correlates to certain vibrations which in turn represent a specific sound signal. Yet another technique involves the analysis of the speckle pattern. A speckle pattern is causes whenever a reflected beam of coherent light creates a spot containing a plurality of interferences. This result in a spot comprising varying intensity dotted pattern reflected from a vibrating surface. One of the ways to analyze a speckle pattern involves the use of a charge couple device (CCD) array or any other array of photosensitive cells serving as receiver units for the reflected speckle pattern, wherein digital signal processing methods help extract the sound signal.

U.S. Pat. No. 7,775,113 shows a laser Doppler vibrometer 100 (LDV) which is one of the common embodiments for Doppler vibrometry. The LDV 100 transmits an outgoing laser beam 120 directed at a flat surface 140. The flat surface may be a window, a wall or a dedicated reflector that have been placed deliberately to act as sound reflector. A sound source 110 generates sound waves that hit the flat surface 140 which result in vibrations. The outgoing laser beam 120, upon hitting the flat surface 140 is reflected back to the LDV 100 wherein the properties of the reflected laser beam 130 has been modified due to the vibrations of the flat surface 140. Inside the LDV 100 the reflected beam is analyzed and compared with a reference beam (not shown) to reconstruct the sound that has been generated by the sound source.

The main drawback of currently available remote sound sensing systems is their poor ability of sound sources separation. This drawback is reflected in two manners: noise separation and blind sources separation. By relying on a beam reflected from a vibrating surface rather than directly the sound generating object, the systems according to the prior art are actually sensing the sound source's ambient, which may include noise that inherently reduces the quality of the sound sensing. In addition, by sensing a reflection from a surface, rather than the sound sources directly, the sound signal extracted actually represents the superposition of all the sound sources presented in the same close proximity. Noise filtering, as well as blind sources separation (the separation of the different unrelated sound sources) has to be performed using time-consuming and not always cost-effective digital signal processing (DSP) techniques.

It would be therefore advantageous to have an apparatus and a method that allows the physical separation of sources while monitoring the sound generated therefrom, as well as noise separation, without the use of complex DSP techniques, while retaining the high quality of remote sound sensing.

The present invention discloses an apparatus and a method that achieve physical separation of sound sources by pointing directly a beam of coherent electromagnetic waves (i.e. laser). Analyzing the physical properties of a beam reflected from the vibrations generating sound source enable the reconstruction of the sound signal generated by the sound source, eliminating the noise component added to the original sound signal. In addition, the use of multiple electromagnetic waves beams or a beam that rapidly skips from one sound source to another allows the physical separation of these sound sources. Aiming each beam to a different sound source ensures the independence of the sound signals sources and therefore provides full sources separation.

In some embodiments, the apparatus for sound source separation according to the present invention is a directional coherent electromagnetic wave based vibrometer. The vibrometer comprises a coherent electromagnetic wave beam transmitter connected to a control unit, which is connected in turn to a processing unit, which is connected in turn to a coherent electromagnetic wave beam receiver via said control unit. Upon operation, the transmitter transmits at least one coherent electromagnetic wave beam directly at least one vibrating sound source. the receiver then receives at least one coherent electromagnetic wave beam reflected directly from at least one vibrating sound source said the processing unit controls said transmitter's operation via said control unit that uses the information extracted from the reflected beam from said vibrating sound source to reconstruct the sound of said sound source whereby the sound of said sound source is being separated from other sound sources and ambient noise.

In some embodiments, a method for separating sound sources using remote sensing sound vibrometry is disclosed. The method comprises the following steps: transmitting at least one coherent electromagnetic wave beam directly at least one vibrating sound source; receiving at least one coherent electromagnetic wave beam reflected directly from at least one vibrating sound source and then analyzing information gathered from the coherent electromagnetic wave beam reflected directly from the vibrating sound source whereby the sound generated by said sound source is separated from other sound sources and ambient noise.

U.S. Pat. No. 7,775,113 shows a schematic diagram of the operational environment according to the present invention. A remote sound sensing apparatus 200 generates an outgoing coherent electromagnetic waves beam 220 that is pointed directly on a vibrations generating sound source 210. Upon hitting the vibrations generating sound source 210, the outgoing coherent electromagnetic waves beam 220 is reflected and returns, with modified physical properties, as a reflected coherent electromagnetic waves beam 230, to the remote sound sensing apparatus 200. When directing the beam at the sound producing source the vast majority of the detected vibrations are related to the sound source. Since the vast majority of the sound producing vibrations related to a sound source are detected, a high degree of separation between the sound source and the ambient is thus achieved. This is due to the fact that the beam is pointed directly at the vibrations producing sound source.

According to some embodiments of the invention, the vibrations generating sound sources 210 may be human beings, wherein the vibrating object may be the skin around the face, lips and throat, but they may be any surface that is attached to the sounding board and/or source that created and/or amplifies the sound According to some embodiments of the invention, the information gathered from the reflected coherent electromagnetic waves beam 230 is extracted in more than one way. Existing techniques may be use. One technique is based on the Doppler Effect; another technique is performing a single interference; a third one is analyzing the speckle pattern—a spot containing multiple interferences.

U.S. Pat. No. 7,775,113 shows a schematic block diagram of the structure of the remote sound sensing apparatus 200 according to some embodiments of the invention. The remote sound sensing apparatus 200 comprises a coherent electromagnetic wave beam transmitter 310 connected to a control unit 330, which is connected in turn to a processing unit, which is connected in turn to a coherent electromagnetic wave beam receiver 320 via said control unit 330. Upon operation, the transmitter 310 transmits at least one coherent electromagnetic wave beam directly on at least one vibrating sound source 210, the receiver 320 then receives at least one coherent electromagnetic wave beam reflected directly from at least one vibrating sound source 210 said the processing unit 340 controls said transmitter's operation via said control unit 330 that uses the information extracted from the reflected beam from said vibrating sound source 210 to reconstruct the sound of said sound source whereby the sound of said sound source is being separated from other sound sources and ambient noise.

According to some embodiments of the invention, each and every module of the invention may be implemented in any hardware or software form. For example, it may be implemented as an application specific integrated circuit (ASIC), as a digital signal processor (DSP), a field programmable gates array (FPGA), a software-based microprocessor or any combination thereof. Moreover, the receiver may be implemented with any array of electromagnetic sensitive cells, such as photo resistive transistors and/or diodes, built in charge coupled device (CCD) and complementary metal oxide silicon (CMOS) technologies and the like.

According to some embodiments, the Doppler Effect is used to extract the vibrations generated by the sound generating object and reconstruct the sound signals.

According to some embodiments of the invention, sound sources separation is achieved by spatial scanning of a plurality of sound sources, whereby at each time, only one beam is assigned at time to one sound source. Specifically, the apparatus according to the present invention generates a plurality of beams or alternatively, one beam that discretely scans the space according to a predefined pattern. At any specific time, a specific beam hits a specific sound source in a mutual exclusive manner and so the information gathered from this beam relates separately to the specific sound source. Thus, physical sources separation is achieved.

U.S. Pat. No. 7,775,113 shows an embodiment according to the invention. According to the embodiment, the vibrometer comprises a self-mixing diode 410 operated by a driver 430 and a collimating lens 420 that focuses the light and directs it on a vibrating sound source 470. The out-coming beam also passes through a modulator 450 that transfers part of the out coming beam to the photo diode 460. Additionally, the beam reflected from the sound source 470 hits a photo diode 460 that in turn transfers the signal to the processing unit 440 the reflecting beam enters the photo diode and cause instabilities that are analyzed in order to reconstruct the sound signal of the sound source.

U.S. Pat. No. 7,775,113 shows the remote sound sensing apparatus 200 surrounded by a plurality of vibrating sound sources 510A-510D. The remote sound sensing apparatus 200 assigns a specific outgoing coherent electromagnetic waves beam 511, 521, 531 and 541, to each of the vibrating sound sources 210A-210D respectively. The reflected beams 512, 522, 532 may be related to each of the specific sound sources 210A-210D in a mutual exclusive manner and therefore source separation is achieved. Multi beam configuration may be is achieved either by one beam that scans the space according to a discrete predefined pattern or by using several beams simultaneously. The scanning scheme is set by the processing unit 340 and controlled by the control unit 330 according to the sound sources spatial position.

According to some embodiments, in the case of several sound sources, the vibrometer may utilize several scanning scheme that may define the size of the spatial angular step which determines the size of a 'cell' in which a sound source may be detected independently. The scanning scheme may be also determined by the scanning frequency and the amount of time the beam stays directed at each discrete step.

U.S. Pat. No. 7,775,113 shows a flowchart describing the steps of the method disclosed according to the present invention. In block 610 at least one coherent electromagnetic wave beam is transmitted directly on at least one vibrating sound source; Then, in block 620 at least one coherent electromagnetic wave beam reflected directly from at least one vibrating sound source is received and finally, in block 630 the information gathered from the coherent electromagnetic wave beam reflected directly from the vibrating sound source is analyzed whereby the sound generated by said sound source is separated from other sound sources and ambient noise.

According to other embodiments of the invention, various DSP techniques may be used to further enhance the quality of the sound signal reconstructed from the information extracted from the reflecting beam. Specifically, these DSP techniques may be used to improve the separation of the sound source that has been greatly improved by the present invention.

In the above description, an embodiment is an example or implementation of the inventions. The various appearances of "one embodiment," "an embodiment" or "some embodiments" do not necessarily all refer to the same embodiments.

Although various features of the invention may be described in the context of a single embodiment, the features may also be provided separately or in any suitable combination. Conversely, although the invention may be described herein in the context of separate embodiments for clarity, the invention may also be implemented in a single embodiment.

Reference in the specification to "some embodiments", "an embodiment", "one embodiment" or "other embodiments" means that a particular feature, structure, or characteristic described in connection with the embodiments is included in at least some embodiments, but not necessarily all embodiments, of the inventions.

It is understood that the phraseology and terminology employed herein is not to be construed as limiting and are for descriptive purpose only.

The principles and uses of the teachings of the present invention may be better understood with reference to the accompanying description, figures and examples.

It is to be understood that the details set forth herein do not construe a limitation to an application of the invention.

Furthermore, it is to be understood that the invention can be carried out or practiced in various ways and that the invention can be implemented in embodiments other than the ones outlined in the description below.

It is to be understood that the terms "including", "comprising", "consisting" and grammatical variants thereof do not preclude the addition of one or more components, features, steps, or integers or groups thereof and that the terms are to be construed as specifying components, features, steps or integers.

If the specification or claims refer to "an additional" element, that does not preclude there being more than one of the additional element.

It is to be understood that where the claims or specification refer to "a" or "an" element, such reference is not be construed that there is only one of that element.

It is to be understood that where the specification states that a component, feature, structure, or characteristic "may", "might", "can" or "could" be included, that particular component, feature, structure, or characteristic is not required to be included.

Where applicable, although state diagrams, flow diagrams or both may be used to describe embodiments, the invention is not limited to those diagrams or to the corresponding descriptions. For example, flow need not move through each illustrated box or state, or in exactly the same order as illustrated and described.

Methods of the present invention may be implemented by performing or completing manually, automatically, or a combination thereof, selected steps or tasks.

The term "method" may refer to manners, means, techniques and procedures for accomplishing a given task including, but not limited to, those manners, means, techniques and procedures either known to, or readily developed from known manners, means, techniques and procedures by practitioners of the art to which the invention belongs.

The descriptions, examples, methods and materials presented in the claims and the specification are not to be construed as limiting but rather as illustrative only.

Meanings of technical and scientific terms used herein are to be commonly understood as by one of ordinary skill in the art to which the invention belongs, unless otherwise defined.

The present invention can be implemented in the testing or practice with methods and materials equivalent or similar to those described herein.

Sound sources separation and monitoring using directional coherent electromagnetic waves. An apparatus and a method that achieve physical separation of sound sources by pointing directly a beam of coherent electromagnetic waves (i.e. laser). Analyzing the physical properties of a beam reflected from the vibrations generating sound source enable the reconstruction of the sound signal generated by the sound source, eliminating the noise component added to the original sound signal. In addition, the use of multiple electromagnetic waves beams or a beam that rapidly skips from one sound source to another allows the physical separation of these sound sources. Aiming each beam to a different sound source ensures the independence of the sound signals sources and therefore provides full sources separation.

(1) A directional coherent electromagnetic wave based vibrometer for sound source monitoring and separation, said vibrometer comprising: a coherent electromagnetic wave beam transmitter; connected to a control unit; connected to a processing unit; connected to a coherent electromagnetic wave beam receiver via said control unit; wherein said transmitter transmits at least one outgoing coherent electromagnetic wave beam directly on at least one vibrating sound source; and wherein said receiver receives at least one coherent electromagnetic wave beam reflected directly from at least one vibrating sound source; and wherein said processing unit controls said transmitter's operation via said control unit that uses the information extracted from the reflected beam from said vibrating sound source to reconstruct the sound of said sound source whereby the sound of said sound source is being monitored and separated from other sound sources and ambient noise. (2) The vibrometer, wherein the coherent electromagnetic waves are laser beam. (3) The vibrometer, wherein the coherent electromagnetic wave beam receiver performs interference between said at least one coherent electromagnetic wave beam reflected directly from at least one vibrating sound source and at least one reference beam that is identical to at least one outgoing coherent electromagnetic wave beam. (4) The vibrometer, wherein the coherent electromagnetic wave beam creates multiple interferences with the outgoing beam creating a speckle pattern and wherein said speckle pattern is analyzed to reconstruct the sound signal of said sound source. (5) The vibrometer, wherein the coherent electromagnetic wave beam reflected from the sound source is analyzed in accordance with the Doppler Effect in order to extract the vibrations of the sound source. (6) The vibrometer, wherein the receiver comprises a self-mixing diode that both generates the electromagnetic beam and receives the reflected electromagnetic wave beam, and wherein the incoming beam enters the diode and cause instabilities that are analyzed in order to reconstruct the sound signal of the sound source. (7) The vibrometer, wherein said receiver comprises electromagnetic waves sensitive cells array implemented in at least one of the following technologies: photo resistive transistors, photo resistive diodes, charge coupled device (CCD), complementary metal oxide silicon (CMOS). (8) The vibrometer, wherein the processing unit is implemented by at least one of the following technologies: ASIC, DSP, FPGA, software-based microprocessor. (9) The vibrometer, wherein the processing unit defines a scanning pattern and wherein said scanning pattern comprise the size of the spatial angular step of the outgoing beam and the speed of scanning. (10) A method for separating sound sources using remote sensing sound vibrometry, said method comprising the steps of: transmitting at least one coherent electromagnetic wave beam directly at least one vibrating sound source; receiving at least one coherent electromagnetic wave beam reflected directly from at least one vibrating sound source; analyzing information gathered from said at least one coherent electromagnetic wave beam reflected directly from said at least one vibrating sound source whereby the sound generated by said sound source is separated from other sound sources and ambient noise. (11) The method, wherein transmitting at least one coherent electromagnetic wave beam is done according to a scanning pattern and wherein said scanning pattern comprise the size of the spatial angular step of the outgoing beam and the speed of scanning. (12) An apparatus for separating sound sources using remote sensing sound vibrometry, said method comprising: means for transmitting at least one coherent electromagnetic wave beam directly at least one vibrating sound source; means for receiving at least one coherent electromagnetic wave beam reflected directly from at least one vibrating sound source; connected to means for analyzing information gathered from said at least one coherent electromagnetic wave beam reflected directly from said at least one vibrating sound source whereby the sound generated by said sound source is separated from other sound sources and ambient noise. (13) The apparatus, wherein the coherent electromagnetic waves beam is laser. (14) The Apparatus, wherein the means for transmitting at least one coherent electromagnetic wave beam operates according to a scanning pattern and wherein said scanning pattern comprise the size of the spatial angular step of the outgoing beam and the speed of scanning.

What is claimed is:

1. A system comprising:

a coherent electromagnetic wave beam receiver to receive a coherent electromagnetic wave beam reflected from a mouth-covering mask which covers a mouth of a human speaker, wherein the mouth-covering mask (i) blocks air exhaled by said human speaker during speech, and (ii) enhances speech-related vibrations during speech, and thereby (iii) enhances quality of remote detection of vibrations resulting from speech carried out by said human speaker wearing said mouth-covering mask;

wherein the coherent electromagnetic wave beam receiver comprises a self-mixing diode that both (a) generates an outgoing coherent electromagnetic wave beam and (b) receives the coherent electromagnetic wave beam reflected from said mouth-covering mask, wherein said mouth-covering mask has a reflective coating on at least a portion of an outer surface of said mouth-covering mask, wherein the reflective coating of said mouth-covering mask is reflective in a signal range corresponding to the signal range of said outgoing coherent electromagnetic wave beam;

a processing unit to reconstruct a sound signal that corresponds to a sound generated by said human speaker wearing said mouth-covering mask, based on analysis of instabilities in said self-mixing diode caused by the coherent electromagnetic wave beam reflected from said mouth-covering mask, wherein said coherent electromagnetic wave beam receiver is separately located from said mouth-covering mask.

2. The system according to claim 1, wherein said reflective coating comprises at least one patch having a reflective surface, wherein said at least one patch is attached to said mouth-covering mask.

3. The system according to claim 1, wherein said reflective coating comprises a coating layer covering at least one area of said mouth-covering mask.

4. The system according to claim 1, wherein at least part of said mouth-covering mask is made from a reflective material.

5. The system according to claim 1, wherein said coherent electromagnetic wave beam receiver is implemented by an optical microphone (a) to transmit a coherent optical beam, and (b) to detect corresponding reflected optical signals from said reflective coating of said mouth-covering mask worn by said human speaker;

wherein the processing unit is to process optical sensed signals for detecting therefrom acoustic signals.

6. The system according to claim 5, wherein the processing unit is to process sensed optical signals for detecting acoustic signals from an output of said optical microphone.

7. The system according to claim 5, comprising at least one audio output device for outputting an output signal of said optical microphone.

8. The system according to claim 1, wherein said processing unit is configured to execute at least one noise reduction algorithm and to output an acoustic signal of said human speaker wearing said mouth-covering mask.

9. A method comprising:

at a coherent electromagnetic wave beam receiver, receiving a coherent electromagnetic wave beam reflected from a mouth-covering mask which covers a mouth of a human speaker, wherein the mouth-covering mask (i) blocks air exhaled by said human speaker during speech, and (ii) enhances speech-related vibrations during speech, and (iii) enhances quality of remote detection of vibrations resulting from speech carried out by said human speaker wearing said mouth-covering mask;

wherein the coherent electromagnetic wave beam receiver comprises a self-mixing diode that both (a) generates an outgoing coherent electromagnetic wave beam and (b) receives the coherent electromagnetic wave beam reflected from said mouth-covering mask, wherein said mouth-covering mask has a reflective coating on at least a portion of an outer surface of said mouth-covering mask, wherein the reflective coating of said mouth-covering mask is reflective in a signal range corresponding to the signal range of said outgoing coherent electromagnetic wave beam;

reconstructing a sound signal that corresponds to a sound generated by said human speaker wearing said mouth-covering mask, based on analysis of instabilities in said self-mixing diode caused by the coherent electromagnetic wave beam reflected from said mouth-covering mask, wherein said coherent electromagnetic wave beam receiver is separately located from said mouth-covering mask.

10. The method according to claim 9, wherein the method is implemented by utilizing an optical microphone, and further comprising transforming output data of said optical microphone into audio signals and outputting said audio signals.

* * * * *